United States Patent [19]

Schick et al.

[11] 4,065,595

[45] Dec. 27, 1977

[54] THERMOGRAPHIC STENCIL SHEET AND METHOD OF MAKING AN IMAGED STENCIL SHEET

[75] Inventors: Margery L. Schick, Mount Prospect; Bror E. Anderson, Arlington Heights, both of Ill.

[73] Assignee: Weber Marking Systems, Inc., Arlington Heights, Ill.

[21] Appl. No.: 521,034

[22] Filed: Nov. 5, 1974

[51] Int. Cl.[2] ..... G03G 5/022

[52] U.S. Cl. ..... 428/141; 101/128.2; 106/189; 106/191; 250/318; 250/475; 282/27.5; 427/143; 427/146; 428/173; 428/412; 428/913

[58] Field of Search ..... 428/141, 173, 913, 412; 427/143, 146, 148; 282/27.5; 101/128.2, 128.4; 106/189, 191; 250/318, 475

[56] References Cited

U.S. PATENT DOCUMENTS

| | | | |
|---|---|---|---|
| 2,769,391 | 11/1956 | Roshkind | 101/149.4 |
| 3,410,636 | 11/1968 | Herrick | 428/141 |
| 3,413,138 | 11/1968 | Georgalas et al. | 428/913 |
| 3,445,261 | 5/1969 | Talvalhat | 428/913 |
| 3,682,763 | 8/1972 | Kubo et al. | 428/913 |
| 3,694,245 | 9/1972 | Anderson et al. | 427/56 |
| 3,824,116 | 7/1974 | Anderson et al. | 428/480 |
| 3,852,091 | 12/1974 | Newman | 428/913 |
| 3,871,899 | 3/1975 | Andersen | 427/143 |
| 3,950,578 | 4/1976 | Laumans | 427/412 |

*Primary Examiner*—George F. Lesmes
*Assistant Examiner*—Stanley S. Silverman
*Attorney, Agent, or Firm*—John S. O'Brien

[57] ABSTRACT

A stencil sheet of the type including an ink-impervious coating of a heat-flowable composition on an ink-pervious base sheet includes two layers of the composition on the base sheet, the first layer having external surfaces made uneven by the unevenness of the underlying base sheet, and the second layer filling the lower areas on one surface of the first layer and providing an even surface on the resulting stencil sheet for intimate contact with an original and attendant advantages.

2 Claims, No Drawings

THERMOGRAPHIC STENCIL SHEET AND METHOD OF MAKING AN IMAGED STENCIL SHEET

BACKGROUND OF THE INVENTION

This invention relates to a thermographic stencil sheet of the type which includes an ink-impervious coating of a heat-flowable composition on an ink-pervious base sheet, and to a method of making an imaged stencil sheet therewith by subjecting image areas of the stencil sheet to heat generated by infrared ray absorption.

A thermographic stencil sheet including an ink-pervious fibrous base sheet and an ink-impervious coating thereon of a heat-flowable composition of thermoplastic film-forming material comprising a cellulose organic ester, and plasticizing material partially but incompletely compatible with the film-forming material is disclosed in various embodiments in U.S. Pat. Nos. 3,694,244, 3,694,245, 3,704,155, 3,824,116 and 3,824,117. The stencil sheet now is in widespread commercial use. It is employed preferably in a stencil sheet assembly including a contacting receiving or absorbent sheet on one surface thereof, and a more rigid backing sheet on the opposite surface thereof and to which the receiving sheet and the stencil sheet are mounted. In use, an original, such as a typed or printed sheet, is inserted between the stencil sheet and the backing sheet, and the assembly is exposed to infrared radiation on the face side of the receiving sheet in a thermocopier such as a Weber Thermal Imager (Weber Marking Systems) or a Thermo-Fax machine (3M Company). Heat is generated in the radiation absorptive graphic portions of the original to cause the stencil sheet composition to flow in corresponding areas and thereby produce corresponding image openings in the stencil sheet. A portion of the composition rendered flowable adheres to and/or is absorbed by the receiving sheet and/or adjoining areas of the stencil sheet. The original and the receiving sheet are separated from the imaged stencil sheet, the stencil sheet and the backing sheet are placed on a mimeograph duplicating machine followed by a separation of the backing sheet, and the machine is operated to produce multiple mimeograph copies of the original.

The improvements provided by the several patents have provided stencil sheets which produce good quality prints, suitable for various uses. However, there remains room for improvement, especially in providing for the variables of materials, procedures and machines encountered in use, which variables may affect copy quality and ease and reliability of operation. While imaging takes place relatively rapidly, advantages would be achieved by further increasing the speed of imaging. It will also be advantageous to increase the latitude of the imaging speed, so as to produce good stencils even though the machine settings may not be optimum.

SUMMARY OF THE INVENTION

The present invention provides a thermographic stencil sheet adapted to be disposed in imaging contact with an original on one side thereof, which includes an ink-pervious fibrous base sheet, a first layer of a heat-flowable composition on the base sheet, said first layer having external surfaces which are uneven or rough due to the unevenness of the underlying base sheet, and a second layer of a heat-flowable composition on the first layer, said second layer filling the lower areas or depressions on one surface of the first layer and providing an even, smooth or level surface on the resulting stencil sheet for intimate contact with an original, said layers providing an ink-impervious coating on the base sheet. The heat-flowable composition for each layer preferably includes a thermoplastic film-forming material comprising a cellulose organic ester, and plasticizing material partially but incompletely compatible with the film-forming material, as disclosed in the above-identified patents.

The invention also provides a method of making an imaged stencil sheet, wherein the new stencil sheet is employed in contact with a graphic original, and image areas of the stencil sheet are subjected to heat generated in image areas of the original by infrared ray absorption to render the coating composition flowable in the stencil sheet image areas, for forming corresponding ink-transmitting image openings in the stencil sheet.

The invention embodies the discovery that imaging can be improved significantly by providing a relatively high degree of evenness or smoothness on the surface of the stencil sheet which contacts the original. The advantages achieved includes faster imaging, wider latitude in imaging time, conservation of coating material, and ability to tailor the properties of the opposite surfaces of the stencil.

It has been found that a stencil sheet according to the invention images on the commercial machines at a numerical setting of from ½ to 1 setting higher or faster. Consequently, the user saves time in making stencils. The light source in the imager is energized for a shorter period of time, which results in less overheating and less need for compensation in the machine, which is not always accurate. Consequently, feathering of the image openings is reduced, over-and underexposure due to poor machine compensation for overheat is reduced, and there is less likelihood of transfer of coating material to other surfaces in certain types of machines.

The increased latitude of imaging speeds enables the user to get good results with a wider range of machine settings. This becomes important when the imaging properties of the stencil are unknown or when operating with unskilled personnel. Copy quality or resolution is, in general, better where the widths of the lines in the characters being reproduced vary, so that no single machine setting is optimum for all line widths. Latitude becomes important also where the thermal imager is in heavy use, and the compensation for overheating is less than optimum.

Provision of the ink-impervious coating in two layers has the advantages over the possible provision of a single, heavy layer that less coating material is required, and imaging speed and quality are better than with a heavier coat. Also, each of the two layers may be adjusted for preferred properties at the respective surfaces of the stencil sheet.

DESCRIPTION OF THE PREFERRED EMBODIMENTS

The stencil sheet of the invention includes a stencil base tissue sheet that may be formed of any suitable fiber, such as abaca fiber, abaca and wood fibers, kozo fiber, or polyester fiber, loosely arranged to provide a foraminous, highly permeable tissue. The tissue may weigh about 4½ to 12 lbs. per 3,000 sq. ft. (24 by 36 inches, 500 sheets).

The first or base layer or coat of the heat-flowable coating composition, which is solid at ambient temperature, is applied to the base sheet at a rate of about 10–15 pounds (dry basis) per 3,000 sq. ft. The first layer is provided in an amount sufficient to provide a substantially complete film, without pinholes, so that the second layer does not penetrate therethrough. The second layer or undercoat is applied to one surface of the first layer at a rate of about 6–12 lbs. per 3,000 sq. ft., sufficient to form an even, smooth or level surface on the side of a stencil sheet on which it is applied. An excess amount of the second layer is to be avoided, inasmuch as more heat is required for imaging, thereby reducing imaging speed and quality, and the surface of the stencil sheet may be tackier, tending to block in a coated roll. The total weight of the resulting thermographic stencil sheet preferably is about 25–29 lbs. per 3,000 sq. ft.

The heat-flowable coating composition preferably is of the type described in the patents identified above. However, the principles of the invention are applicable to other types of heat-flowable compositions. It is further preferred to employ a coating composition including a thermoplastic polymeric hydrocarbon resin and/or an alkylene oxide ester or either, as disclosed in U.S. Pat. Nos. 3,824,116 and 3,824,117. It is preferred that the coating composition melt at a temperature of at least about 65° C., preferably in the range of about 65°–180° C., more preferably, about 90°–160° C. (a coating composition melting point as referred to herein is determined as the temperature at which the composition on a stencil sheet visibly melts or liquefies). Inasmuch as the preferred compositions of the latter patents are fully disclosed therein, it is believed to be unnecessary to repeat the disclosure thereof herein, but such disclosure is incorporated herein by reference.

The layers of heat-flowable composition preferably are solvent-deposited on the base sheet, as described for the preferred embodiments in the foregoing patents, for example. Depending upon the quantity to be deposited, the coating composition materials may be incorporated by mixing in a solvent mixture at a concentration of about 20–35% by weight in the preferred embodiments, also as described in the foregoing patents. In the examples which follow, the coating compositions were formulated in a solvent mixture of (in parts by weight) 50 parts of toluene, 36 parts of ethyl acetate, and 14 parts of anhydrous isopropanol.

The formula of the coating composition can be varied in the respective layers, so long as the properties of the layers do not change significantly on standing over the desired shelf life, due to migration of ingredients from one layer to the other. Thus, the respective layers may be formulated so as to provide better durability, less tackiness, better oil transfer properties, and other characteristics which may be preferred for one layer or the other. A specific example of a variation which may prove to be advantageous is the use of silica gel in one layer, to reduce tackiness, while omitting the same from the other layer, for proper imaging properties. The use of silica gel is disclosed in U.S. Pat. No. 3,694,244. The silica gel preferably is included in the first layer and omitted in the second layer, and this combination, surprisingly, provides a faster imaging stencil than when silica gel is provided in the second layer alone, or in both layers.

The base tissue sheet may be coated by any suitable applicator, and excess composition is removed by suitable means such as a doctor rod. The first layer may be dried by air at ambient temperature or by warm air. Subsequent layers are preferably dried rapidly with heated, circulated air, so as to minimize any effect of the solvent on the preceeding layer. The stencil sheet is dried between applications at least sufficiently to be about dry to the touch, and so that compositions will not be removed from the sheet by guide rolls and the like. Ultimately, the stencil sheet is dried to a volatiles content below about 0.5%, by weight.

Stencil imaging as reported in the examples was tested by mounting the stencil sheet on a 63 lb. unoiled backing sheet. A porous absorbent tissue sheet was mounted over the stencil, the sheet being a 10 lb. per 2,880 sq. ft. tissue formed of abaca and wood pulp fibers (Grade 55 tissue, Dexter Corporation). Offset or typed originals were inserted between the stencil and the backing sheet for imaging on a Weber Thermal Imager Model No. 511 or a Thermo-Fax Model 45CG "Secretary" machine. Stencils were printed on a Weber Model 50 (Weber Marking Systems) label printer type of mimeograph stencil duplicating machine.

Illustrative materials which may be employed in the invention are disclosed in the above-identified patents. Materials which are employed in the examples herein are described as follows:

Cellulose Ester

CAB 500-1 is cellulose acetate butyrate grade EAB 500-1 (Eastman Chemical Products) having an average butyryl content of 49.6%, an average acetyl content of 5.5%, a hydroxyl content of 0.1–0.7%, a viscosity of 0.8–1.2 seconds (ASTM method D-1343-54T in Formula A, ASTM method D-871-54T), and a melting point range of about 165°–175° C.

Silica Gel

Syloid 255 (Davidson Division, W. R. Grace Company) is silica gel having an oil absorption of about 315 lbs./100 lbs., a particle size range of 0.8–12 microns (90%), and an average particle size of about 3–4 microns.

Plasticizing Material

Mobilsol L (Socony Mobil Oil Co.) is a refined naphthenic petroleum oil having a viscosity of 61 Saybolt seconds (SUS) at 38° C., a straight aniline point of 74° C., an API gravity of 25.7°, and a distillation range of 254°–270° C. (100%).

Univolt 33 (Exxon Corporation) is a naphthenic petroleum oil having a viscosity of 59 Saybolt seconds at 38° C. and 34.2 Saybolt seconds at 99° C., a straight aniline point of 65.5° C., and a flash point (Cleveland) of 154.5° C..

Cumar R-9 (Neville Chemical Co.) is a coumarone-indene resin, described in U.S. Pat. No. 3,824,116, having a softening point of 111.5° C., a specific gravity at 25° C. of 1.141, an iodine number of 51.2, a mixed aniline point of 46.8° C., a molecular weight of 613, a viscosity of 1 poise at 195° C. and 10 poises at 159° C., and a refractive index at 25° C. of 1.632.

Brij 92 (ICI America) is polyoxyethylene ether of oleyl alcohol (2 moles of ethylene oxide) having an HLB (Atlas Hydrophile-Lipophile Balance) of 4.9, an acid number of 1.0 max., and a hydroxyl number of 160–180. It has a typical viscosity of approximately 30 centipoises at 25° C. (ASTM No. D445-54T), and a theoretical mixed aniline point of −2.8° C.

Hercolyn D (Hercules, Inc.) is a hydrogenated methyl ester of rosin purified by steam distillation, a liquid having a Gardner-Holdt viscosity at 25° C. of Z2–Z3 and an acid number of 7. Its mixed aniline point is 58° F.

Antioxidants which may be included in the stencils include dilauryl thiodipropionate (DLTDP) and Plastanox 425, 2,2'-methylene-bis(4-ethyl-6-t-butylphenol). Preservatives which may be employed in the stencil sheet include butylated hydroxytoluene (BHT) and citric acid.

The following examples illustrate stencil sheets prepared according to the invention. It will be understood that the invention is not limited to the examples, which are merely illustrative, or to the materials, proportions, conditions and procedures set forth therein.

EXAMPLE 1

Stencil sheets were prepared from the following heat-flowable composition of thermoplastic film-forming material and plasticizing material partially but incompletely compatible with the film-forming material:

| Material | Parts by Weight | Parts by Volume |
|---|---|---|
| CAB 500-1 | 19.9 | 16.8 |
| Cumar R-9 | 22.3 | 20.0 |
| Mobilsol L | 38.0 | 41.5 |
| Brij 92 | 19.6 | 21.5 |
| DLTDP | 0.2 | 0.2 |

A single-coated stencil sheet according to the above identified prior patents was prepared, and compared with a double-coated stencil sheet according to the invention. In preparing the single-coated sheet, the composition was incorporated in the solvent described above at a concentration of 32% by weight. A base tissue sheet was employed which weighed 6.7 lbs. per 3,000 sq. ft. (Grade 251 tissue, Dexter Corporation). The composition was applied by pulling the tissue from a roll across a rotating applicator roll picking up solution from a pan therebeneath. Excess coating was removed by a doctor rod, and the coated sheet was dried to a residual solvent content below about 0.5% volatiles by circulating low velocity air heated to about 130° F. The product had a total coated weight of 26 lbs. per 3,000 sq. ft., corresponding to an application of the coating composition of 19.3 lbs. per 3,000 sq. ft.

A double-coated sheet was prepared with the above composition, employing the composition in a concentration of 28.5% by weight to deposit the first layer on the same grade base tissue sheet, and in a concentration of 32% by weight to deposit the second layer thereon. The procedure for applying the first layer was the same as described above for a single coat, except that the first layer requires drying only to the touch. The coating procedure was repeated to deposit the second layer on one side of the first layer. The total coated weight of the sheet with the first layer only was 18 lbs. per 3,000 sq. ft., corresponding to a deposit of 11.3 lbs. of composition per 3,000 sq. ft. The total coated weight of the stencil sheet having both layers thereon was 26 lbs. per 3,000 sq. ft., corresponding to 8 lbs. of composition deposited in the second layer per 3,000 sq. ft. The total composition deposited on the base tissue sheet was 19.3 lbs. per 3,000 sq. ft.

When the stencil sheets were imaged according to the above-described procedures, both showed good quality of resolution on the Model 45 CG imager. For the single-coated sheet, the optimum setting on the imager was 6, and the latitude was 4½ to 6½, which latitude is rated from good to very good. The optimum setting on the imager for the double-coated stencil was 6.5, an increase in imaging speed of ½ setting. The latitude in this case was 5 to 7½, rated very good, an increase in latitude of ½ setting.

EXAMPLE 2

Another composition which may be employed in the manner of Example 1 with improved results when two layers of the heat-flowable composition are employed is the following:

| Material | Parts by Weight | Parts by Volume |
|---|---|---|
| CAB 500-1 | 16.6 | 13.8 |
| Cumar R-9 | 18.9 | 16.3 |
| Univolt 33 | 48.3 | 51.8 |
| Brij 92 | 16.2 | 17.7 |
| DLTDP | 0.1 | 0.1 |
| BHT | 0.1 | 0.1 |
| Plastanox 425 | 0.2 | 0.2 |

The foregoing composition was provided in two layers on a 6.7 lb. base tissue sheet in the same manner as Example 1. The composition in the first layer also was tinted with 0.0041 lbs. per 100 lbs. of solids, of Orasol Yellow 2GL and 0.044 lbs. per 100 lbs. of solids, of Orasol Blue 2GL. Syloid 255 was incorporated in the composition for application of the second layer only, at a rate of 4 lbs. per 100 lbs. of remaining solids.

The coated weight with the first layer on the base sheet was 20.1, corresponding to a net weight of 13.3 lbs. of composition per 3,000 sq. ft. The coated weight with two layers of composition applied to the base sheet was 28 lbs. per 3,000 sq. ft., corresponding to 8 lbs. of composition per 3,000 sq. ft. in the second layer, and a total of 21.3 lbs. of composition per 3,000 sq. ft. in both layers on the base sheet.

The stencil sheet had an optimum setting of 6 and a latitude of 5 to 6½, rated good, on the Model 45CG imager. The stencil sheet had an optimum setting of 3½ and a latitude of 2½ to 4, rated good, on the Model 511 imager. The quality of resolution was rated good on both imagers.

EXAMPLE 3

Similarly improved results are obtained following the procedures of Example 1 and employing the following heat-flowable composition of thermoplastic film-forming material and plasticizing material partially but incompletely compatible with the film-forming material:

| Material | Parts by Weight | Parts by Volume |
|---|---|---|
| CAB 500-1 | 20.7 | 17.4 |
| Hercolyn D | 36.0 | 34.8 |
| Mobilsol L | 43.2 | 47.8 |

We claim:

1. A thermographic stencil sheet adapted to be disposed in imaging contact with an original on one side thereof, which comprises:

an ink-pervious fibrous stencil base tissue sheet having a weight of about 4½ to 12 lbs. per 3,000 sq. ft., a first layer of a heat-flowable composition provided on the tissue sheet by deposition of the composition on the tissue sheet from a volatile solvent solution thereof and removing the solvent therefrom by drying until at least about dry to the touch, said first layer when dry having external surfaces which are uneven due to the unevenness of the underlying tissue sheet, and a second layer of a heat-flowable composition provided on said first layer by deposition of the composition on the first layer from a volatile solvent solution thereof and removing solvent therefrom by drying, said second layer filling the low areas on one surface of said first layer and providing an even surface on the resulting stencil sheet for intimate contact with an original, said heat-flowable composition for each layer including a thermoplastic film-forming material comprising a cellulose organic ester, and plasticizing material partially but incompletely compatible with the film-forming material, said layers providing an ink-impervious coating on the tissue sheet.

2. A thermographic stencil sheet as defined in claim 1 wherein the amounts of said composition contained in said layers are, in lbs. per 3,000 sq. ft., 10–15 lbs. in said first layer and 6–12 lbs. in said second layer.

* * * * *